United States Patent [19]

Uozumi et al.

[11] 4,343,281

[45] Aug. 10, 1982

[54] FUEL SYSTEM FOR INTERNAL COMBUSTION ENGINE

[75] Inventors: Yasuzi Uozumi, Tokyo; Makoto Hashiguchi, Ohi; Fumiaki Kikuchi, Kamifukuoka, all of Japan

[73] Assignee: Honda Giken Kogyo Kabushiki Kaisha, Tokyo, Japan

[21] Appl. No.: 139,356

[22] Filed: Apr. 11, 1980

[30] Foreign Application Priority Data

Apr. 19, 1979 [JP] Japan ..... 54-51428[U]

[51] Int. Cl.[3] ..... F02M 33/02

[52] U.S. Cl. ..... 123/519; 123/520

[58] Field of Search ..... 123/519, 518, 520, 521

[56] References Cited

U.S. PATENT DOCUMENTS

| | | | |
|---|---|---|---|
| 3,616,783 | 11/1971 | Masters | 123/519 |
| 3,831,572 | 8/1974 | Csicsery | 123/519 |
| 3,937,198 | 2/1976 | Sudhir | 123/519 |
| 4,153,025 | 5/1979 | Thornburgh | 123/520 |
| 4,173,207 | 11/1979 | Hiramatsu | 123/519 |
| 4,176,639 | 12/1979 | Shinoda et al. | 123/520 |

FOREIGN PATENT DOCUMENTS

| | | | |
|---|---|---|---|
| 55-23348 | 2/1980 | Japan | 123/520 |
| 55-60650 | 5/1980 | Japan | 123/519 |

*Primary Examiner*—Ira S. Lazarus
*Assistant Examiner*—Magdalen Moy
*Attorney, Agent, or Firm*—Lyon & Lyon

[57] ABSTRACT

A fuel system for an internal combustion engine employs a conduit connecting a fuel tank to a canister. A two-way valve in the conduit opens to permit flow when vapor pressure in the fuel tank exceeds a predetermined limit or falls below a predetermined limit. A bypass line is connected to the conduit, bypassing the two-way valve and containing an electrically-operated valve device which opens in response to closing of two series-connected switches, the first switch automatically closing when the engine is running, and the second switch closing when the engine coolant reaches a high temperature.

2 Claims, 1 Drawing Figure

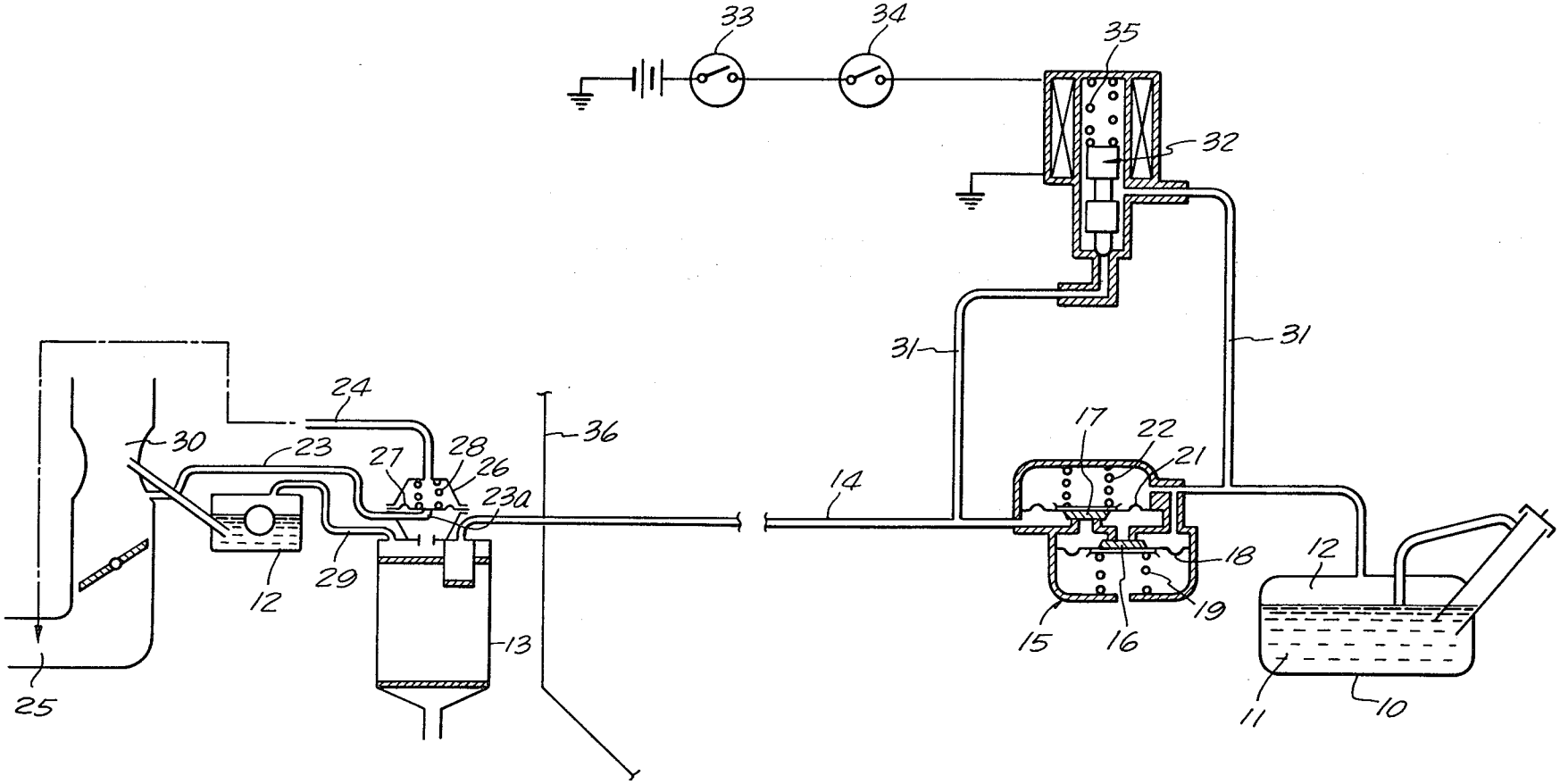
10
11
12
31
32
35
18
19
21
22
16
17
15
31
34
14
33
36
13
28
26
23a
27
24
29
23
12
30
25

FUEL SYSTEM FOR INTERNAL COMBUSTION ENGINE

This invention relates to fuel systems for internal combustion engines. Fuel systems of this type commonly employ a conduit connecting a fuel tank to a canister. Suction in the engine intake passage draws fuel vapor from the canister into the engine intake passage. A two-way valve in the conduit comprises a positive pressure valve adapted to open in response to a positive pressure in the fuel tank, and includes a negative pressure valve adapted to open in response to a negative pressure in the fuel tank. In this type of control device, a pressure chamber defined at the rear side of the positive pressure valve is usually in communication with the atmosphere, so that the pressure chamber is under the influence of atmospheric pressure. Therefore, when the temperature of the fuel tank increases immediately after the engine ceases operation, to cause a considerable increase in the internal pressure in the fuel tank, the increased internal pressure acts on the canister to cause a rapid flow of fuel through the canister. Furthermore, the increased internal pressure acts on an associated fuel feed line which has a bad effect on operation of the carburetor, and associated fuel pump or other related engine parts.

It is an important object of the present invention to provide an internal pressure control device which reduces the above-mentioned drawbacks.

Other objects and advantages will appear hereinafter.

The drawing is a schematic representation showing a preferred embodiment of this invention.

As shown in the drawing, the fuel tank 10 which contains a body of liquid fuel 11 and a vapor chamber 12 is connected to a canister 13 by means of a conduit 14. A two-way valve 15 is mounted in the conduit 14 and includes a positive pressure valve 16 adapted to open in response to positive internal pressure in the tank 10, and also includes a negative pressure valve 17 adapted to open in response to negative internal pressure in the tank 10. The valve 16 opens when pressure above the diaphragm 18 overcomes the force of the spring 19. The valve 17 opens when suction pressure on the diaphragm 21 overcomes the force of the spring 22. Accordingly, the two-way valve 15 opens to permit flow through the conduit 14 when the vapor pressure in the fuel tank 10 exceeds a predetermined limit or falls below a predetermined limit.

The conduit 14 extends through a wall 30 of the engine compartment and connects to the upper portion of the canister 13, which canister in turn communicates with the venturi portion 30 of the carburetor by way of the tube 23. A negative pressure-actuated valve 26 is interposed between the canister 13 and the tube 23, and this valve 26 opens a valve port **23*a* of the tube 23 in response to suction pressure within the intake passage 25. The valve 26 has a construction similar to that of the valves 16 and 17 and it opens when the suction pressure above the diaphragm 27 overcomes the force of the spring 28. In the illustrated embodiment, fuel vapor which is produced in the float chamber 12 is also introduced into the canister 13 by means of conduit 29**.

In accordance with this invention, a bypass passage 31 is connected to the conduit 14 in a manner to bypass the two-way valve 15. An electrically-operated valve device 32 is positioned in this bypass passage 31 to control the flow therethrough. An electric switch 33 which closes automatically when the engine is running and another electric switch 34 are connected in series with the electrically-operated valve device 32. The electric switch 34 closes automatically when a control signal is received during operation of the engine, for instance when the temperature of the engine cooling water is high. When both switches 33 and 34 are closed, the valve device 32 opens against the spring 35 to open the bypass line 31.

In operation, fuel vapor in the fuel tank 10 from the space 12 is carried through the conduit 14 into the canister 13 to be absorbed therein. The absorbed fuel vapor is then drawn into the venturi portion 30 through the tube 23 in accordance with the vacuum pressure generated in the venturi portion 30 by the valve 26. The valve 26 opens the valve port **23*a* in response to the vacuum pressure in the intake passage 25 when the engine is running. Furthermore, in operation, the positive pressure valve 16 opens when the internal pressure in the fuel tank 10 is positive, while the valve 17 opens when the internal pressure is negative. When the control signal is issued during operation of the engine, for instance when the temperature of the engine cooling water is high, the valve device 32 is opened electrically to cause the internal pressure in the fuel tank 10 to approach atmospheric pressure and thereby minimize the rise of internal pressure which occurs by reason of the increase in tank temperature immediately after the engine ceases running. The valve device 32 is kept in its closed position when the engine is not running and when no control signal is issued during the operation of the engine, for instance, when the temperature of the engine cooling water is low, so that the fuel vapor in the fuel tank 10 is guided into the canister 13 solely through the two-way valve 15**.

The canister is not charged with too much fuel vapor immediately after the engine ceases operating, thereby avoiding passage of the fuel vapor through the canister to the atmosphere. Also, the carburetor is protected against abrupt changes in the internal pressure in the conduit 14.

Having fully described our invention, it is to be understood that we are not to be limited to the details herein set forth but that our invention is of the full scope of the appended claims.

We claim:

1. In a fuel system for an internal combustion engine, the system including a fuel tank, a canister and means connecting the canister to the intake passage of the engine, the improvement comprising, in combination: a conduit connecting the fuel tank to the canister, valve means in said conduit normally preventing flow therethrough, said valve means opening to permit flow through said conduit when vapor pressure in the fuel tank exceeds a predetermined limit or falls below a predetermined limit, a bypass line connected to said conduit and bypassing said valve means, means including a first electric switch closing when the engine is running, means including a second electric switch closing when an engine operating condition exists, and an electrically-operated valve device in said bypass line adapted to open in response to closing of both of said switches.

2. The combination set forth in claim 1 in which said engine operating condition comprises high temperature of the engine coolant.

* * * * *